US011684817B2

(12) United States Patent
Clanton

(10) Patent No.: US 11,684,817 B2
(45) Date of Patent: Jun. 27, 2023

(54) FULL BODY WORKOUT DEVICE

(71) Applicant: Rafiq Clanton, Elmont, NY (US)

(72) Inventor: Rafiq Clanton, Elmont, NY (US)

( * ) Notice: Subject to any disclaimer, the term of this patent is extended or adjusted under 35 U.S.C. 154(b) by 137 days.

(21) Appl. No.: 17/177,263

(22) Filed: Feb. 17, 2021

(65) Prior Publication Data

US 2022/0047913 A1 Feb. 17, 2022

Related U.S. Application Data

(60) Provisional application No. 63/066,261, filed on Aug. 16, 2020.

(51) Int. Cl.
*A63B 21/00* (2006.01)
*A63B 23/12* (2006.01)

(52) U.S. Cl.
CPC ..... *A63B 21/4035* (2015.10); *A63B 21/4034* (2015.10); *A63B 21/4049* (2015.10); *A63B 23/1236* (2013.01)

(58) Field of Classification Search
CPC ..... A63B 21/0004; A63B 21/00058; A63B 21/00069; A63B 21/012; A63B 21/015; A63B 21/065; A63B 21/22; A63B 21/4015; A63B 21/4019; A63B 21/4027; A63B 21/4033; A63B 21/4034; A63B 21/4035; A63B 21/4039; A63B 21/4049; A63B 22/20; A63B 22/201; A63B 22/203; A63B 23/035; A63B 23/03516; A63B 23/03533; A63B 23/03541; A63B 23/03575; A63B 23/04; A63B 23/0405; A63B 23/047; A63B 23/12; A63B 23/1209; A63B 23/1236; A63B 2208/0295
See application file for complete search history.

(56) References Cited

U.S. PATENT DOCUMENTS

| | | | | |
|---|---|---|---|---|
| 4,892,305 | A * | 1/1990 | Lynch | A63B 22/20 482/146 |
| 6,942,605 | B1 * | 9/2005 | Sukhovitsky | A63B 21/4017 2/24 |
| 7,621,858 | B2 * | 11/2009 | Sheron | A63B 21/0618 482/129 |
| 8,827,879 | B2 * | 9/2014 | Nicholas | A63B 23/0355 482/141 |
| 9,199,117 | B1 * | 12/2015 | Nicholas | A63B 21/068 |
| 9,511,251 | B2 * | 12/2016 | Chang | A63B 23/1227 |
| 9,623,273 | B1 * | 4/2017 | Chen | A63B 21/4034 |
| 9,961,948 | B2 * | 5/2018 | Archuleta | A41D 13/065 |
| 10,610,724 | B2 * | 4/2020 | Chuang | A63B 21/0442 |

(Continued)

*Primary Examiner* — Gary D Urbiel Goldner
(74) *Attorney, Agent, or Firm* — Brennan, Manna & Diamond, LLC

(57) ABSTRACT

The present invention relates generally to the field of exercise equipment. More specifically, the present invention relates to an improved full body workout device that is designed to allow a user to exercise every muscle in the body. The device comprises at least two pairs of weighted sliders for the hands and feet of a user, wherein each slider comprises a track ball that allows each slider to slide along a surface such as the ground. Each slider is further comprises plurality of controls to allow the user to lock the track ball in place to make each slider immobile, and may also comprise a control that allows a user to select the intensity of the exercise being performed with the device.

17 Claims, 5 Drawing Sheets

(56) References Cited

U.S. PATENT DOCUMENTS

| | | | | |
|---|---|---|---|---|
| 10,737,135 | B2 * | 8/2020 | Chuang | A63B 23/02 |
| 10,933,278 | B2 * | 3/2021 | Moridaira | A63B 22/20 |
| 2005/0245372 | A1 * | 11/2005 | Mylrea | A63B 23/1236 482/141 |
| 2009/0298656 | A1 * | 12/2009 | Dannenberg | A63B 22/14 482/141 |
| 2010/0130337 | A1 * | 5/2010 | Stewart | A63B 23/12 482/141 |
| 2010/0317496 | A1 * | 12/2010 | Abranchess | A63B 23/12 482/141 |
| 2011/0071008 | A1 * | 3/2011 | Coates | A63B 23/03541 482/131 |
| 2012/0083396 | A1 * | 4/2012 | Aquino | A63B 21/4035 482/131 |
| 2013/0252791 | A1 * | 9/2013 | Chang | A63B 23/0222 482/132 |
| 2013/0345033 | A1 * | 12/2013 | Peck | A63B 26/00 482/142 |
| 2014/0018217 | A1 * | 1/2014 | Brown | A63B 23/1236 482/132 |
| 2014/0100090 | A1 * | 4/2014 | Lima | A63B 23/1236 482/139 |
| 2014/0182041 | A1 * | 7/2014 | Archuleta | A41D 13/065 2/24 |
| 2015/0111705 | A1 * | 4/2015 | Walker | A63B 23/0211 482/66 |
| 2016/0089576 | A1 * | 3/2016 | Rosenstiel | A63B 21/0407 482/146 |
| 2016/0287932 | A1 * | 10/2016 | Brown | A63B 21/0004 |
| 2017/0050082 | A1 * | 2/2017 | Whitaker | A63B 23/03508 |
| 2018/0036588 | A1 * | 2/2018 | Brown | A63B 23/03541 |
| 2018/0185702 | A1 * | 7/2018 | Brown | A63B 21/068 |

* cited by examiner

FULL BODY WORKOUT DEVICE

CROSS-REFERENCE TO RELATED APPLICATION

The present application claims priority to, and the benefit of, U.S. Provisional Application No. 63/066,261, which was filed on Aug. 16, 2020 and is incorporated herein by reference in its entirety.

FIELD OF THE INVENTION

The present invention relates generally to the field of exercise equipment. More specifically, the present invention relates to a full body workout device that is designed to allow a user to exercise every muscle in the body. The workout device is comprised of at least two pairs of weighted sliders, one pair for the user's hands and one pair for the user's feet. Each of the weighted sliders is comprised of a track ball that allows each slider to slide along a surface, such as the ground, and a plurality of controls. The plurality of controls allows the user to, among other things, lock the track ball in place to immobilize the slider, and control the intensity of the exercise being performed with the sliders by adjusting the frictional resistance between the track ball and the surface on which it is in contact. Accordingly, the present disclosure makes specific reference thereto. Nonetheless, it is to be appreciated that aspects of the present invention are also equally applicable to other like applications, devices and methods of manufacture.

BACKGROUND OF THE INVENTION

Exercise plays an important role in maintaining a healthy body, preventing injury and disease and improving one's strength and muscle/cardiovascular endurance. Accordingly many individuals frequent public gyms to workout where various training and exercise machines are available to allow users to work and strengthen each part of the body and each muscle that they desire. However, an individual may not be able to attend a public gym due to pandemic-related health restrictions, a lack of any public gyms nearby and/or the inability to pay for a gym membership.

Further, many types of gym exercise equipment for the home are expensive, with most pieces of equipment costing thousands of dollars. Therefore, individuals who may be forced to exercise at home due to any number of the constraints described above may not be able to afford multiple pieces of expensive exercise equipment to adequately train all parts of the individual's body, as even in a public commercial gym a wide variety of machines typically must be used to achieve a full body workout. As such, it is difficult to find a single piece of exercise equipment that will adequately target every muscle in the body, and that is also cost effective and affordable. Additionally, many existing exercise equipment/machines currently available in the marketplace and generally used in a gym are bulky, heavy and not readily portable by any means. This makes using said machines inconvenient for most people who may have a machine at their residence, but may also desire to workout while traveling away from home.

Therefore, there exists a long felt need in the art for a full body workout device that allows an individual to work all muscles of the body. There is also a long felt need in the art a full body workout device that does not require a user to buy various independent machines to exercise different muscles or body parts. Additionally, there is a long felt need in the art for a full body workout device that is budget friendly and affordable by modest standards, and that is relatively lightweight, slim, and portable. Furthermore, there is a long felt need in the art for a full body workout device that enables an individual to control the intensity of the exercise performed using the device. Finally, there is a long felt need in the art for a full body workout device that is relatively inexpensive to manufacture and that is both safe and easy to use.

The subject matter disclosed and claimed herein, in one embodiment thereof, comprises a full body workout device designed to allow a user to target all of the various muscles of the body and to complete a full body workout. The exercise device is preferably comprised of a pair of hand slider devices and a pair of foot slider devices, wherein each of the hand slider devices and each of the foot slider devices is comprised of a housing, a handle or foot pocket, a control panel and a 360-degree rotatable ball. The handle or foot pocket may be integrally formed with the housing or may be a separate component attached thereto. The handle is useful for grasping and gripping the hand slider device, and the foot pocket allows an individual to attach the foot slider device to their foot by inserting his or her foot into the foot pocket. The 360-degree rotatable ball is partially positioned within the housing, and extends outwardly from a bottom surface of the housing for contacting a surface such as the ground. More specifically, the presence of the 360-degree rotatable ball partially extending out of the base or bottom of the housing allows each of the hand and foot sliders to rotate and slide along a surface, such as the ground. Further, the control panel allows the individual to, among other things, enable or disable the rotation/movement of the slider device via the 360-degree rotatable ball, and increase the difficulty/intensity of using each of the slider devices by increasing/decreasing the amount of friction between the ball and the ground surface during movement of each slider device.

In this manner, the novel full body workout device of the present invention, which also may be referred to as the "Body Bust Down Machine", accomplishes all of the forgoing objectives and provides a relatively easy, convenient and cost-effective solution for exercising and strengthening all of the muscles of the body via a portable, low-cost, and full-body exercise device. The full body workout device of the present invention is also user friendly, inasmuch as it is less expensive than traditional alternatives, does not require a user to buy multiple exercise machines to train different muscles and body parts, and also enables an individual to adjust the exercise intensity level as per his or her needs and requirements.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a full body workout device that allows a user to exercise all muscles/body parts using various maneuvers, movements and exercises. The device is comprised of a pair of hand slider devices and a pair of foot slider devices, wherein each hand slider device and each foot slider device is comprised of a bottom surface that is comprised of an integrated 360-degree rotatable track ball that allows each slider to move along a flat surface such as the ground. Each hand slider device is further comprised of a handle for grasping and gripping the hand slider device, and each foot slider device is further comprised of a foot pocket and heel strap to allow an individual to secure his or her foot within the foot slider device. Each of the hand sliders and foot sliders is also comprised of a control button that allows the individual to enable or disable the rotation/movement of the track ball to prevent or allow movement of the device as desired. Each slider may also be comprised of an adjustability switch that allows the user to increase the difficulty of using each device slider between easy, regular and hard by adjusting the friction of the track ball during movement. The slider devices of the present invention are particularly advantageous as the rotation of the ball can be enabled or disabled, and the difficulty level of each slider can also be set by the individuals accordingly to his or her needs or preferences. Further, in alternative embodiments of the present invention, each slider or set of sliders can be further comprised of a plurality of fixed weights, or may be comprised of a mechanism to allow an individual to add additional weight to each slider.

In another embodiment of the present invention, a method of performing full body exercises using the full body workout device of the present invention is disclosed. The method comprises the initial step of the individual setting a intensity level for each of the hand and foot slider devices in accordance with his or her needs and/or objectives. Next, the individual will place each of his or her feet in a foot pocket of a respective one of the foot slider devices, and then grasp one of the handles of the hand slider devices in each hand. The individual will then reposition himself or herself into a prone or lying face down position, and begin to repeatedly extend and retract his or her arms and legs outwardly/inwardly in relation to the individual's body in the same or a variety of different directions to exercise the individual's muscles of choice. As the individual's arms and legs are extended and retracted, the various hand slider devices and foot slider devices glide across the surface on the 360-degree rotatable track ball.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
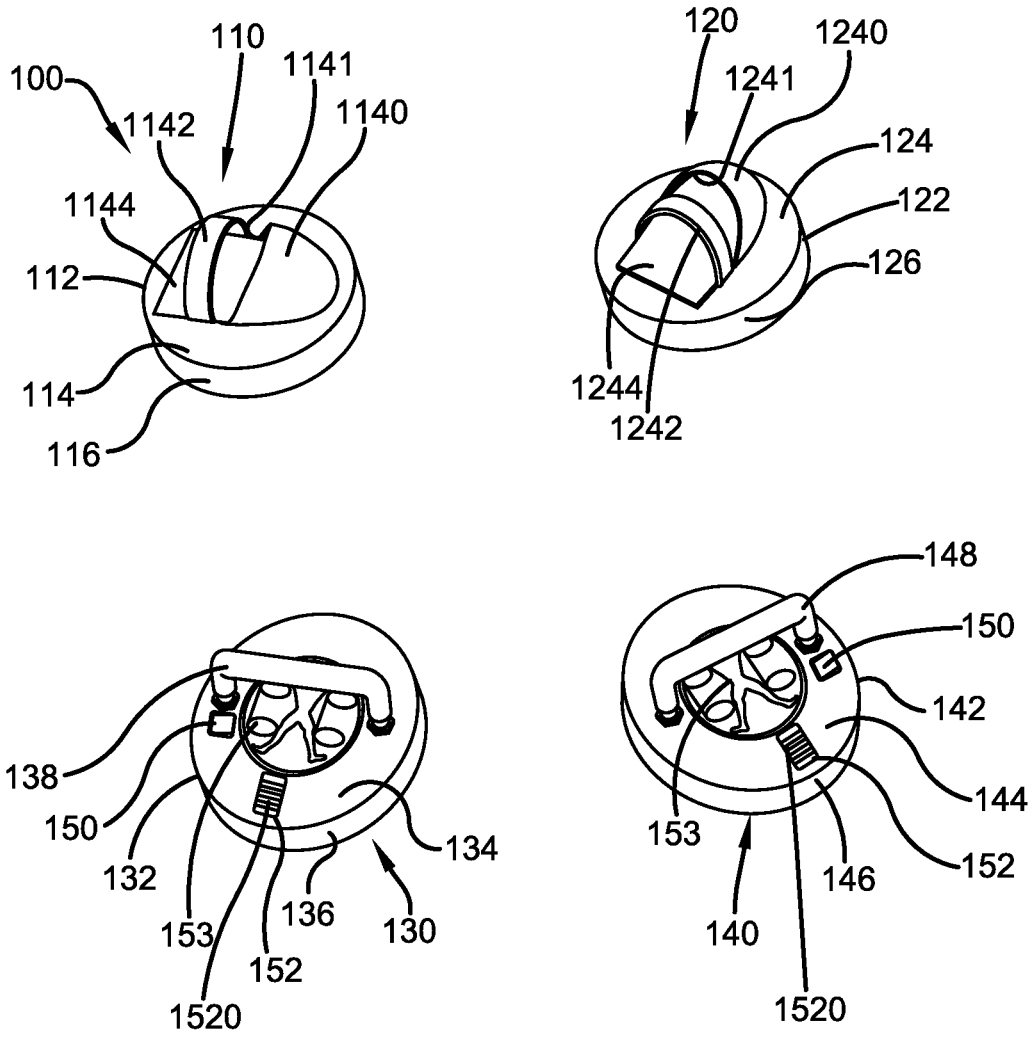
FIG. 1 illustrates a perspective view of one potential embodiment of the full body workout device of the present invention in accordance with the disclosed architecture, wherein the device comprises a pair of hand slider devices and a pair of foot slider devices.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a full body workout device that allows a user to train all of his or her muscles and parts of the body, and that does not require the user to purchase a plurality of independent exercise machines. Additionally, there is a long felt need in the art for a full body workout device that is both affordable and easily transportable, and that enables the user to dictate the intensity of the exercise that he or she is performing. Finally, there is a long felt need in the art for a full body workout device that is relatively inexpensive to manufacture, and is both safe and easy to use.

Referring initially to the drawings, FIG. 1 illustrates a perspective view of one potential embodiment of the full body workout device or system 100 of the present invention in accordance with the disclosed architecture, wherein the system 100 device comprises a pair of foot slider devices and a pair of hand slider devices. More specifically, the pair of foot slider devices is comprised of a first foot slider 110 and a second foot slider 120, and the pair of hand sliders is comprised of a first hand slider 130 and a second hand slider 140. Each of the foot and hand sliders 110, 120, 130, 140 is preferably comprised of a general circular, rigid plastic body or housing that is further comprised of a bottom surface 112 (for the first foot slider 110 and so on), 122, 132, 142, a top surface 114 (for the first foot slider 110 and so on), 124, 134, 144, and a side surface 116 (for the first foot slider 110 and so on), 126, 136, 146. However, the shape of the housing of each slider is not so limited and it is contemplated that, in alternative embodiments of the device 100, the various slider devices 110, 120, 130, 140 may be comprised of other body shapes such as, but not limited to, a square, rectangle, triangle, trapezoid, hexagon, octagon, oval, etc. Further, the body of any of slider devices 110, 120, 130, 140 may be comprised of any number of differing durable materials such as, but not limited to, aluminum, stainless steel, fiberglass, injection molded plastic, polycarbonate plastic, acrylonitrile-butadiene-styrene, etc.

It also contemplated that the body of each slider device 110, 120, 130, 140 may be hollow, or may be comprised of a plurality of internal voids 156 or pockets/compartments to allow a user to fill each body with, for example, a weighted material such as water, sand, rocks, etc. via a cap 1320 that may be positioned on the bottom surfaces 112, 122, 132, 142 and/or side surfaces 116, 126, 136, 146 of any of the slider devices 110, 120, 130, 140. Further, the various slider devices 110, 120, 130, 140 may be comprised of differing materials such that each slider device has a different weight, or the same material, wherein each slider 110, 120, 130, 140 weighs the same amount (e.g. five pounds each). Further, the device 100 may also be presented as a kit that is comprised of multiple sets of first and second foot slider devices 110, 120 and first and second hand slider devices 130, 140, wherein each set is comprised of a specific weight (e.g. one set is comprised of sliders that weigh five pounds, one set is comprised of sliders that weight ten pounds, etc.).

Figure 2A:
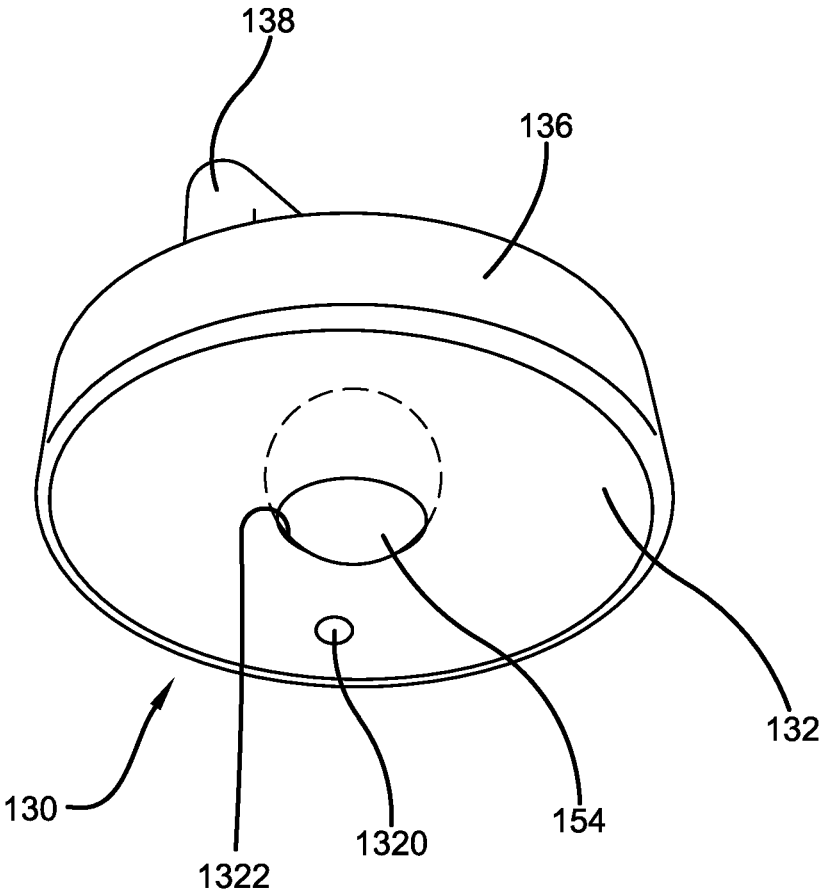
FIG. 2A illustrates a perspective bottom view of one potential embodiment of a hand slider device of the full body workout device of the present invention in accordance with the disclosed architecture wherein the 360-degree rotatable track ball is clearly visible.

FIG. 2A illustrates a perspective bottom view of one potential embodiment of a first hand slider device 130 of the full body workout device 100 of the present invention in accordance with the disclosed architecture wherein a 360-degree rotatable track ball is clearly visible. More specifically, the bottom surface 132 of the first hand slider 130 (and of each other type of slider 110, 120, 140) may be comprised of a cap 1320, a continuous opening 1322, and a 360-degree rotatable track ball 154, wherein the track ball 154 protrudes slightly outwards from the bottom surface 112, 122, 132, 142 of each of sliders 110, 120, 130, 140 via the continuous opening 1322 to allow the ball 154 to make contact and roll along a flat surface, such as the ground. In a preferred embodiment of the device 100, each track ball 154 is comprised of a solid, smooth, spherical body manufactured from a durable material such as aluminum or stainless steel. However, it should also be noted that in an alternative embodiment, the device 100 may be comprised of a plurality of track balls 154 that may be arranged along the bottom surface 112, 122, 132, 142 of each slider 110, 120, 130, 140 in a linear, non-linear or radial fashion. Alternatively, the device 100 may be comprised of a plurality of wheels (not shown) in lieu of track balls 154, though the use of the track ball 154 offers 360 degree rotation.

Figure 2B:
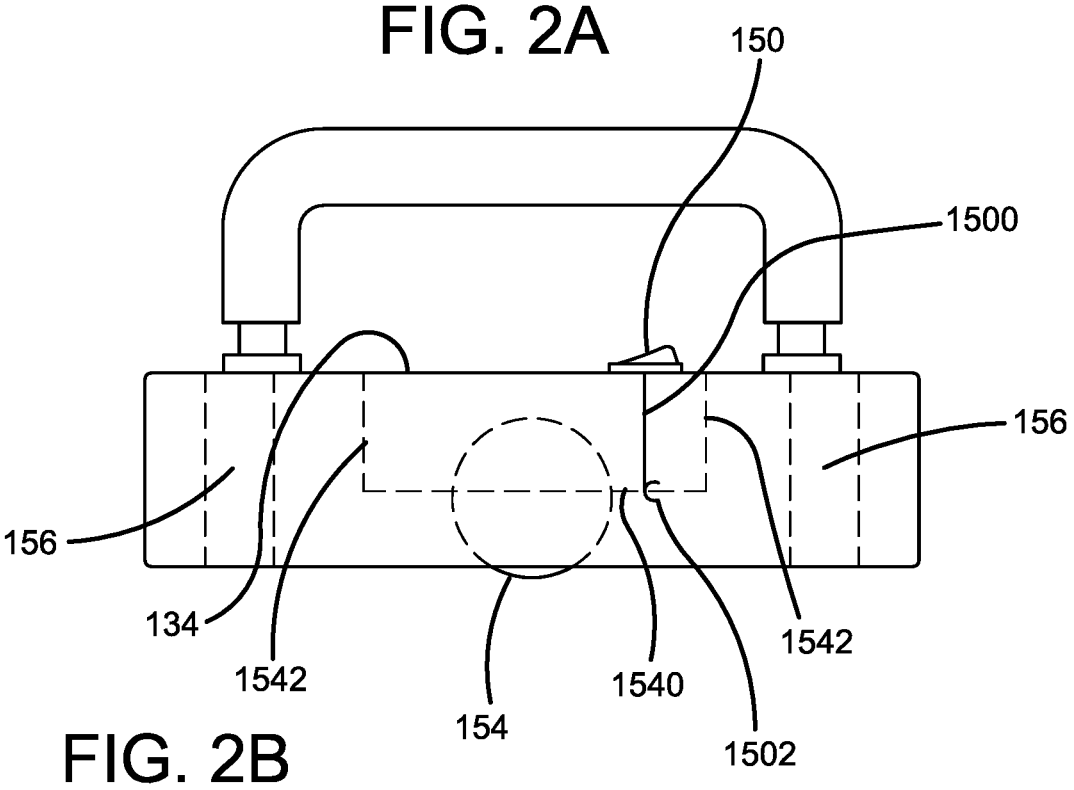
FIG. 2B illustrates a cross sectional side view of one potential embodiment of a hand slider device of the full body workout device of the present invention in accordance with the disclosed architecture.

FIG. 2B illustrates a cross sectional side view of one potential embodiment of a hand slider device of the full body workout device of the present invention in accordance with the disclosed architecture. More specifically, each track ball 154 may be comprised of an internal axle 1540 that is fixedly attached via two vertical arms 1542 to the underside of the top surface 114, 124, 134, 144 within each slider device 110, 120, 130, 140 body. The axle 1540 is further positioned and fixedly attached through the center of the ball 154 in a horizontal fashion wherein the ball 154 may roll/rotate along the axle 1540. A control button 150 is then able to lock the movement of the ball 154 when the user toggles or pushes the button 150 to the "locked" or "unlocked" position which causes a generally c-shaped clamp 1502, that is connected to the underside of the button 150 via a vertical arm 1500, to clamp around the axle 154, thereby preventing the further movement of the axle 1540 and the ball 154.

Alternatively, the ball 154 may be enclosed by a convex internal housing (not shown) that is slightly larger than the ball 154 but contoured to match its shape, wherein the housing is comprised of a plurality of ball bearings (not shown) that comprise a buffer (e.g. middle layer) between the inner surface of the housing and the outer surface of the ball 154, such that the ball 154 is free to move in any direction along a ground surface, yet remains contained within the housing within each slider device 110, 120, 130, 140. Each ball 154 then ultimately allows each slider device 110, 120, 130, 140 to move along a surface during exercise, as will be explained more fully below.

As best shown in FIG. 1, each of first and second foot slider devices 110, 120 is further comprised of a mounting bracket 1144, 1124 that may be fixedly (e.g. via a weld or an integral forming processing during manufacturing) or removably attached (e.g. via mechanical fasteners or a plurality of magnets) to each top surface 114, 124. Each bracket 1144, 1124 is further comprised of a foot pocket 1140, 1240 having a continuous opening 1141, 1241 therein that allows a user to insert each of their feet into each pocket 1140, 1240 to use each feet slider device 110, 120, as will be shown more fully below when discussing FIGS. 4 and 5. Each foot pocket 1140, 1240 may be fixedly (e.g. via a weld or an integral forming processing during manufacturing) or removably attached (e.g. via mechanical fasteners or a plurality of magnets) to each bracket 1144, 1244 respectively. Furthermore, differing embodiments of the device 100 may be comprised of foot sliders 110, 120 that are comprised of a plurality of differing bracket and pocket sizes to accommodate a wide range of user foot 16 sizes. In addition, each bracket 1144, 1244 may be comprised of a corresponding heel strap 1142, 1242 having hook and loop fasteners, snaps, buttons or the like that allows the straps 1142, 1242 to be secured around the heel or foot 16 of a user to further secure the user's feet 16 into each feet slider device 110, 120.

Figure 3:
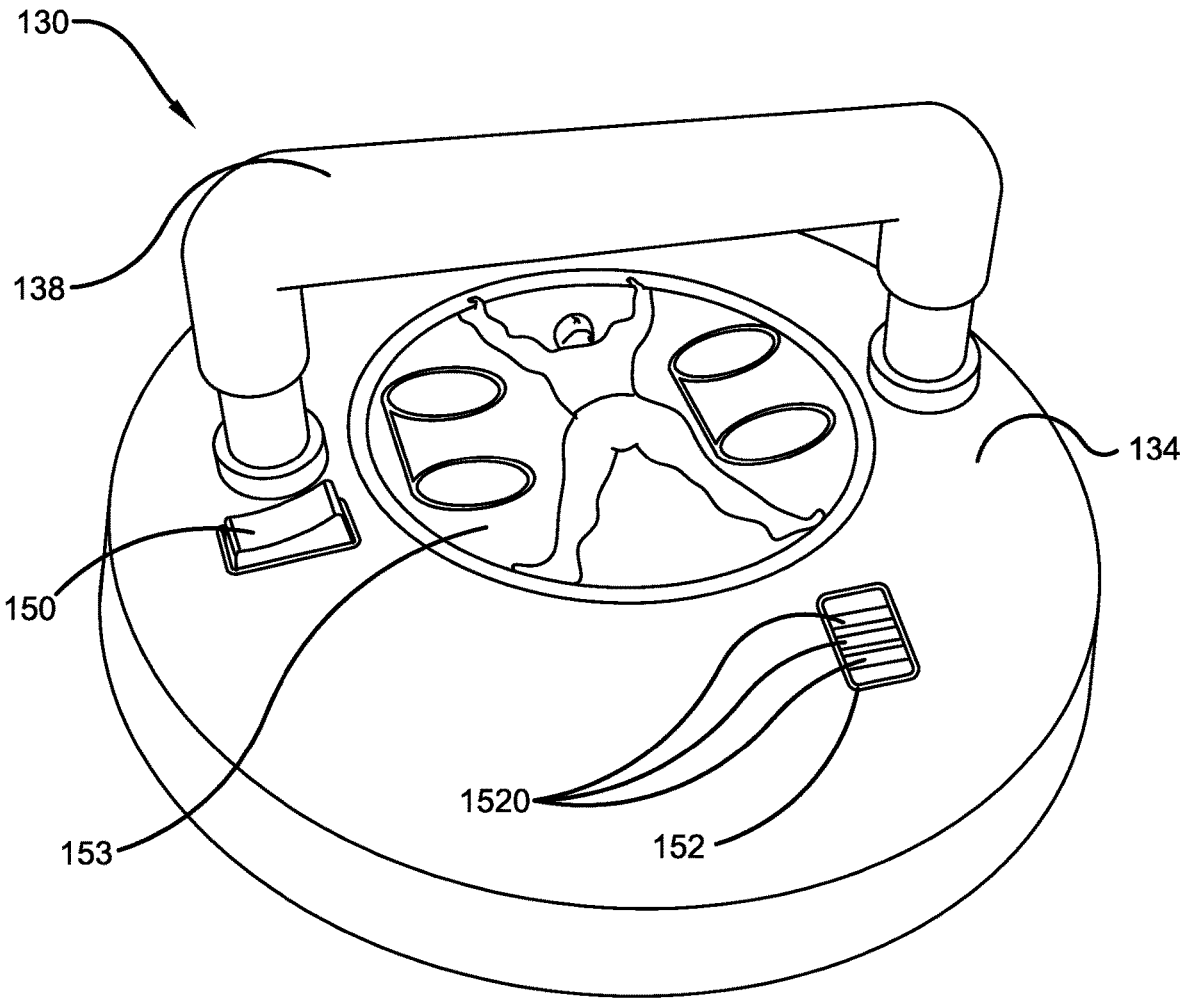
FIG. 3 illustrates a partial perspective view of one potential embodiment of a hand slider device of the full body workout device of the present invention in accordance with the disclosed architecture.

FIG. 3 illustrates a partial perspective view of one potential embodiment of a first hand slider device 130 of the full body workout device 100 of the present invention in accordance with the disclosed architecture. More specifically, each hand slider 130, 140 is comprised of a handle 138, 148 that is fixedly attached to a top surface 134, 144 and which may further be padded, unpadded, and/or contoured/non-contoured to fit the hand 14 of a user 10. Nonetheless, in a differing embodiment of the device 100, handles 132, 142 may be magnetically attached to each top surface 134, 144, or may attach via a removable fastening means such as a screw (not shown), a grooved channel (not shown), a locking slot (not shown), etc. As will be explained more fully below when discussing FIGS. 4 and 5, each handle 132, 142 allows a user 10 to easily grip each hand slider 130, 140 with their hands 14 while exercising. The top surface 134, 144 of each hand slider 130, 140 and/or a portion of the top surface 114, 124 of each foot slider 110, 120 may be further comprised of a logo 153. The logo 153 may be embossed, flush with or raised in relation to the top surface 114, 124, 134, 144, and may be comprised of a plurality of indica such as a brand logo, advertisement, image, photo, symbol, pattern, etc.

Each top surface 114, 124, 134, 144 of the first and second foot and hand sliders 110, 120, 130, 140 may further be comprised of an on/off or control button 150. The on/off button 150 may be comprised of a push-button or toggle switch style button that allows a user to lock the movement of the track ball 154 of each slider device 110, 120, 130, 140 in place, thereby preventing the slider device 110, 120, 130, 140 from moving (i.e. sliding or rolling) when placed on a surface. Each top surface 114, 124, 134, 144 may further be comprised of an intensity switch 152 or a plurality of toggle or push button intensity buttons 1520, which allows a user to control the resistance of ball 154 as it rotates about the axle 1540 or within the internal housing. Further, each level of intensity (e.g. easy, medium, hard, etc.) that can be selected by the intensity switch 152 corresponds to the degree in which the c-shaped clamp 1502 engages the axle 1540 such that "hard" may involve the clamp 1502 coming into contact with a substantially greater surface area of the axle 1504 than that of the "medium" or "easy" settings, which involve less contact of the axle 1540. As such, the clamp 1502 would create a sufficient and corresponding amount of friction between the clamp 1502 and axle 1540 such that the movement of the ball 154 is inhibited to the desired degree of difficulty.

Figure 4:
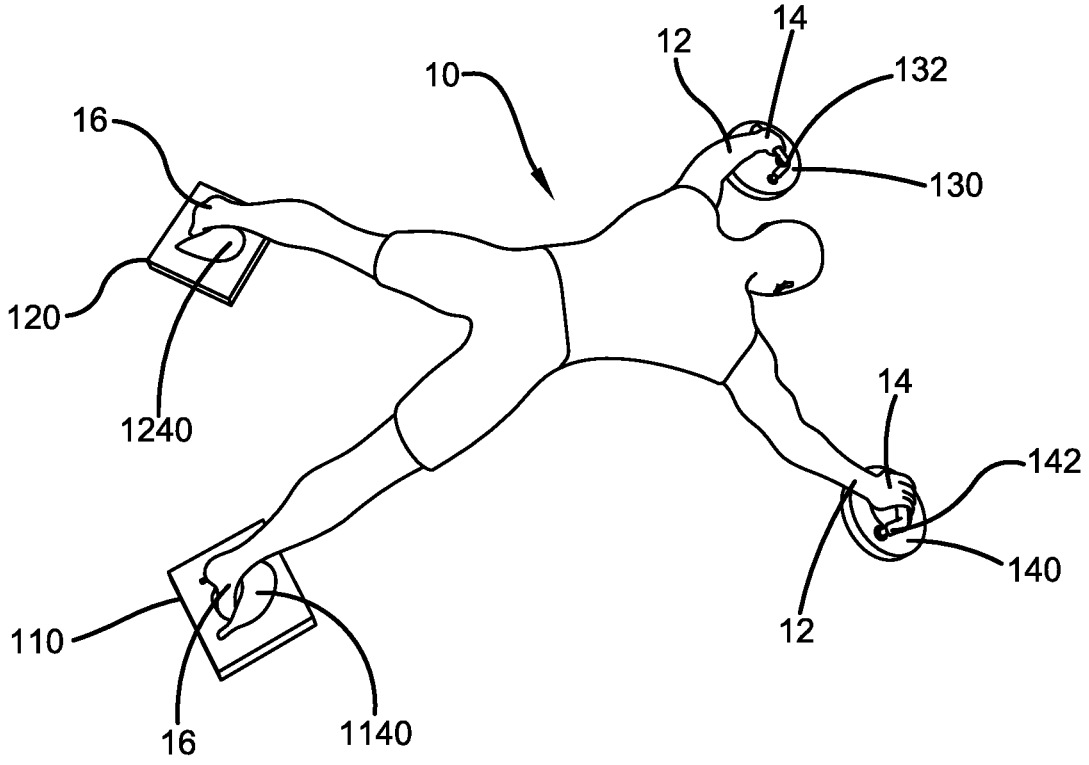
FIG. 4 illustrates a perspective view of a user using one potential embodiment of the full body workout device of the present invention in accordance with the disclosed architecture, wherein the user is face down with a hand slider device firmly gripped in each of his hands and a foot slider device firmly secured to each of his feet.

FIG. 4 illustrates a perspective view of a user 10 using one potential embodiment of the full body workout device 100 of the present invention in accordance with the disclosed architecture, wherein the user 10 is face down with a hand slider 130, 140 device firmly gripped in each of his hands, and a foot slider device 110, 120 firmly secured to each of his feet. For example, to perform a full body exercise using the device 100, the user 10 inserts his first foot 16 into the foot pocket 1140 of the first slider device 110, and inserts his other foot 16 into the foot pocket 1240 of the second foot slider device 120. The user 10 may then further secure his feet 16 within the pockets 1140/1240 via each heel strap 1142/1242. The user 10 may then also grab each handle 138/148 of each hand slider device 130/140 with his hands 14. A user 10 then positions his body in an outstretched position by moving his arms 12 and feet 16 away from his body in a controlled or rapid manner. The user 10 may then further move each slider device 110, 120, 130, 140 in a coordinated manner or a series of motions to exercise his entire body or a specific body part. A user 10 can perform any number of conceivable exercises such as planks, ab/core exercises, upper body exercises, lower body exercises, stretches etc. using the device 100 by moving each slider device 110, 120, 130, 140 along a surface via each wheel 154. The user 10 can also perform static exercises such as, but not limited to, push up type exercises, shoulder exercises, core exercises, etc. with each wheel 154 locked in place, therefore ensuring each slider device 110, 120, 130, 140 is immobilized.

Figure 5:
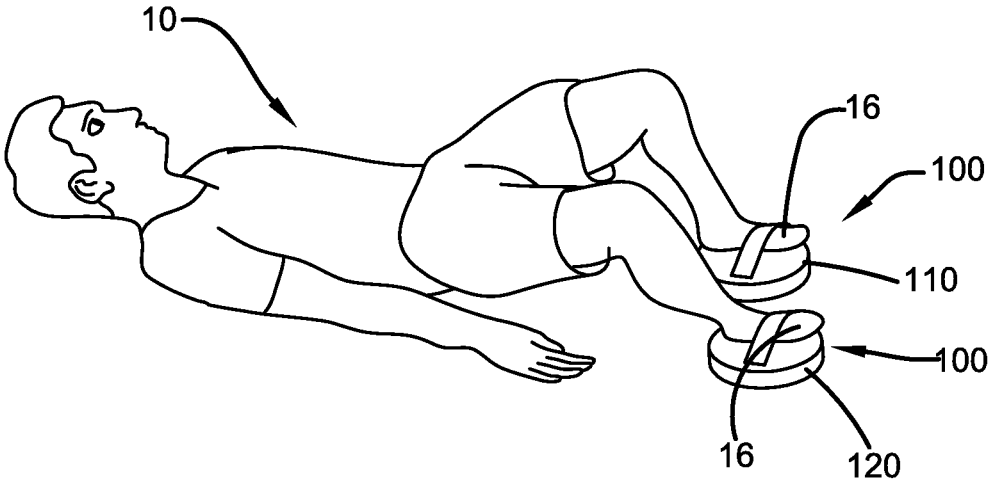
FIG. 5 illustrates a perspective view of a user using one potential embodiment of the full body workout device of the present invention in accordance with the disclosed architecture, wherein the user is positioned on his back with his knees partially bent and a foot slider device firmly secured to each of his feet.

FIG. 5 illustrates a perspective view of a user 10 using one potential embodiment of the full body workout device 100 of the present invention in accordance with the disclosed architecture, wherein the user 10 is positioned on his back with his knees partially bent and a foot slider device 110, 120 firmly secured to each of his feet 16. More specifically, the user 10 inserts each foot 16 into its own foot pocket 1140, 1240 of each foot slider 110, 120, and may then perform a controlled movement, for example, to slide each foot 16 away from their body to stretch their hamstrings via the slider devices 110, 120.

Notwithstanding the forgoing, the full body workout device 100 of the present invention can be of any suitable size and configuration as is known in the art without affecting the overall concept of the invention, provided that it accomplishes the above stated objectives. One of ordinary skill in the art will appreciate that the size, configuration and material of the full body workout device 100 as shown in the FIGS. are for illustrative purposes only, and that many other sizes and shapes of the full body workout device 100 are well within the scope of the present disclosure. Although the dimensions of the full body workout device 100 are important design parameters for user convenience, the full body workout device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof. Such modifications also include exercises/motions/stretches that can be achieved by a user using the device 100.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A full body workout system comprising:

a first foot slider device;

a second foot slider device;

a first hand slider device; and a second hand slider device; and wherein each of the first and second foot slider devices comprises a heel strap, a removably attachable mounting bracket, and a foot pocket removably attachable to the respective mounting bracket and comprising a continuous opening horizontally facing a rear portion of the respective mounting bracket.

2. The full body workout system as recited in claim 1, wherein each of the first hand slider device and the second hand slider device comprises a handle.

3. The full body workout system as recited in claim 1, wherein each of the first foot slider device, the second foot slider device, the first hand slider device and the second hand slider device comprises a rotatable ball.

4. The full body workout system as recited in claim 3, wherein the rotatable ball extends partially outside of a bottom surface of each of the first foot slider device, the second foot slider device, the first hand slider device and the second hand slider device.

5. The full body workout system as recited in claim 3, wherein each of the first foot slider device, the second foot slider device, the first hand slider device and the second hand slider device comprises an on/off button for controlling a movement of the rotatable ball.

6. The full body workout system as recited in claim 3, wherein each of the first foot slider device, the second foot slider device, the first hand slider device and the second hand slider device comprises an intensity control for controlling an amount of resistance in a movement of the rotatable ball.

7. The full body workout system as recited in claim 1, wherein each of the first foot slider device, the second foot slider device, the first hand slider device and the second hand slider device comprises an axle.

8. The full body workout system as recited in claim 1, wherein each of the first foot slider device, the second foot slider device, the first hand slider device and the second hand slider device comprises an internal void and a cap.

9. The full body workout system as recited in claim 1, wherein each of the first foot slider device, the second foot slider device, the first hand slider device and the second hand slider device comprises a vertical arm and a clamp.

10. A body workout system comprising:

a first foot slider device; and a second foot slider device; and wherein each of the first and second foot slider devices comprises a plurality of internal voids configured to retain a weighted material and a cap for covering the plurality of internal voids.

11. The body workout system as recited in claim 10, wherein each of the first foot slider device and the second foot slider device further comprises a foot pocket.

12. The body workout system as recited in claim 11, wherein each of the first foot slider device and the second foot slider device further comprises a heel strap.

13. The body workout system as recited in claim 10, wherein each of the first foot slider device and the second foot slider device further comprises a rotatable ball.

14. The body workout system as recited in claim 13, wherein the rotatable ball extends partially outside of a bottom surface of each of the first foot slider device and the second foot slider device.

15. The body workout system as recited in claim 13, wherein each of the first foot slider device and the second foot slider device further comprises an on/off button for controlling a movement of the rotatable ball and an intensity control for controlling an amount of resistance in the movement of the rotatable ball.

16. A body workout system comprising:

a first hand slider device; and a second hand slider device; and wherein each of the first hand slider device and the second hand slider device comprises a handle and a rotatable ball, and further wherein each rotatable ball extends partially outside of a bottom surface of each of the first hand slider device and the second hand slider device; and wherein each rotatable ball comprises an internal axle fixedly attached to an underside of a top surface of each of the first hand slider device and the second hand slider device via a pair of vertical arms.

17. The body workout system as recited in claim 16, wherein each of the first hand slider device and the second hand slider device comprises an on/off button for controlling a movement of the rotatable ball and an intensity control for controlling an amount of resistance in the movement of the rotatable ball.

* * * * *